United States Patent [19]

Del Bon et al.

[11] 4,410,110

[45] Oct. 18, 1983

[54] VALVE-AND-LID ASSEMBLY FOR A CONTAINER

[76] Inventors: Luigi Del Bon, Feldstrasse 141; Franco Del Bon, Feldstrasse 139, both of 4663 Aarburg, Switzerland

[21] Appl. No.: 259,159

[22] Filed: Apr. 30, 1981

[30] Foreign Application Priority Data

Aug. 5, 1980 [CH] Switzerland ..... 5912/80

[51] Int. Cl.[3] ..... B65D 83/14

[52] U.S. Cl. ..... 222/402.24; 222/402.1; 222/402.21; 222/402.22; 222/402.23; 251/120

[58] Field of Search ..... 222/402.1, 402.13, 402.15, 222/402.21, 402.22, 402.23, 402.24, 511, 512, 513, 514, 518; 251/120, 170, 390

[56] References Cited

U.S. PATENT DOCUMENTS

| | | | |
|---|---|---|---|
| 2,662,668 | 12/1953 | Schmidt . | |
| 2,662,669 | 12/1953 | Schmidt . | |
| 2,696,934 | 12/1954 | Ashton . | |
| 3,144,179 | 8/1964 | Gildone . | |
| 3,272,403 | 9/1966 | Alexander . | |
| 3,434,633 | 3/1969 | Green | 222/402.22 |
| 3,633,798 | 1/1972 | Webster | 222/402.22 |
| 4,171,074 | 10/1979 | Diamond | 222/402.22 |

FOREIGN PATENT DOCUMENTS

| | | |
|---|---|---|
| 2048915 | 3/1971 | France . |
| 2354260 | 1/1978 | France . |

*Primary Examiner*—Joseph J. Rolla
*Assistant Examiner*—Jan Koniarek
*Attorney, Agent, or Firm*—Heinrich W. Herzfeld

[57] ABSTRACT

A valve-and-lid assembly comprises a self-closing discharge valve constituted by a dome part, having a central opening, of a lid closing the open top end of a pressurized container and serving as the obturating member of the valve by obturating ducts through a valve disc of elastically resilient material which is lodged in the dome part. When opening the valve by downward or tilting pressure exerted with the aid of a tubulure or the like actuating member on the valve disc, the latter is deformed so as to establish free communication between at least one of the ducts therein and the hollow interior of the tubulure which can carry a conventional atomizer head having a spray nozzle.

16 Claims, 10 Drawing Figures

VALVE-AND-LID ASSEMBLY FOR A CONTAINER

BACKGROUND OF THE INVENTION

This invention relates to a self-closing valve-and-lid assembly adapted for closing the open top end of a container fillable with fluid pressurized product.

A known assemblies of this kind, such as is described for instance in German Offenlegungsschrift No. 27 22 265 of George Bernard Diamond, comprises a discharge valve mounted in the lid and having a product outlet, a valve disc or gasket, and a valve body which cooperates with the valve disc when the valve is in closed position and thus obturates the product outlet. Usually, the valve body is of a material which is rigid under the conditions of filling the container through the valve with product and/or propellant or dispensing product from the container by opening the valve. The lid of the known assembly comprises a cup-shaped dome part which is vaulted out of the central region of a flat lid part, and the valve disc is usually placed inside this vaulted dome part and held in place therein usually by a part of a valve housing. When opening the known valve, the valve body and the valve disc or gasket have their positions changed relative to one another in such a manner that a gap is opened between them through which gap the valve product is dispensed from the container.

However, in this known valve-and-lid assembly, the manufacture of the several parts which usually comprise a spring member biassing the valve body into closed position, is costly, and especially when producing the valve shaft bearing the atomizer head by injection molding, relatively complicated.

OBJECTS AND SUMMARY OF THE INVENTION

It is, therefore, an object of the invention to provide a valve-and-lid assembly which consists of a minimum of two to three parts of easy manufacture.

This object and others which will become apparent from the following description of the invention are attained in a self-closing valve-and-lid assembly of the initially described type comprising (a) a lid the periphery of which is adapted for being sealingly connected with a top rim of a container sidewall surrounding the said container top opening, and extending generally transverse to a central assembly axis which lid has a central dome part and a central opening in the middle of the dome part, and a flat lid part about the dome part and extending generally in a main lid plane transverse to the central assembly axis, the lid being made of a material hich is rigid under conditions of filling product into, and discharging product from the container, a collar portion of said dome part extending axially relative to said central assembly axis and ending in an annular rim about said central dome part opening;

the dome part having a top wall and a circumferential sidewall which latter extends generally out of the main lid plane, and the collar portion extending from said dome part top wall toward the main lid plane, but ending at or near the latter plane;

(b) a valve disc being of a material which is elastically resilient under the above-defined conditions, and having a peripheral disc zone which is firmly clamped in the central dome part, and a central contact zone of the disc being, in closed state, in sealing contact with at least the collar portion of the dome part; the valve disc having an inner disc face thereof turned toward the collar portion, and at least one duct extending through the disc from a face thereof turned away from the contact zone to the said inner disc face and opening out of the latter face in the central contact zone; and (c) finger-engageable actuating means which, when actuated, so deforms the valve disc in the range of the said central contact zone that at least part of the contact zone is moved out of engagement with the collar portion, thereby opening a free passage through at least one duct from outside the disc face turned away from said contact zone to outside said central opening of said dome part.

Preferably, the dome part protrudes from the flat lid part on the side thereof adapted to be turned toward the interior of the container.

In certain embodiments of the valve-and-lid assembly, a riser tube can be inserted in the collar portion and extend into the container interior, opening in a bottom zone of the container.

The interior of the riser tube is in communication with the duct or ducts of the valve disc when the latter is deformed by transverse pressure on the actuating means to open a gap between the lid surface and the valve disc surface in contact therewith, while such communication is interrupted when the valve disc is at rest or closure position in the dome part.

In a further embodiment, the valve disc comprises a sleeve part depending from the contact zone and extending downward into the interior of the collar portion between an inner wall of the latter and the riser tube, and the riser tube has an open top end at a level in the collar portion spaced from the contact zone of the valve disc above the collar portion; the sleeve part has at least one window therein opening into the space between the open top end of said riser tube and the contact zone of the disc thereabove.

In a further, preferred embodiment of the valve-and-lid assembly according to the invention, the dome part protrudes from the flat lid part on the side of the latter adapted for facing away from the interior of a container, when the assembly is mounted on the container.

In this case, the actuating means are advantageously connected with the inner valve disc face inside the central opening of the dome part and protrude upwardly out of the opening. More particularly, the actuating means can be of tubular shape and can have an axial passage, which registers with the central opening of the dome part, and an inner end wall resting in positive contact with the contact zone of the valve disc inside the central dome part opening; this end wall of the actuating means has at least one port therein, adapted for registering with a gap formed between the annular rim of the collar portion and the contact zone of the valve disc, when finger pressure is exerted on the actuating means. The tubular actuating means can advantageously be integral with the valve disc.

The actuating means can also comprise a valve actuating rod which is mounted centrally on the outside surface of the valve disc, and an enveloping, preferably conical mantle having a discharge opening at its top end or apex and a circumferential foot rim which is connected with the same outside surface of the valve disc but outside the outlets of the ducts of the valve disc.

The opening at the apex is closed, in rest position, by the preferably conically tapered tip of the rod, thus providing a second sealing in addition to the primary sealing effect between the valve disc and lid. This double seal does not require any special precision manufacturing and will nevertheless be satisfactory when pressures prevailing in the container on the product are 3 to 5 bars in excess of ambient pressure.

In preferred embodiments of the valve-and-lid assembly of the invention, it is particularly easy to fill product and/or propellant into the container after the valve-and-lid assembly has been firmly mounted on the container top rim, for instance by peripheral crimping in a manner known per se. No tilting or depression of an actuating memeber is required during filling.

Advantageously, the valve disc face opposite the inner disc face, which opposite face is turned toward the interior of the container, comprises a peripheral skin portion covering the underside of the entire lid which underside faces toward the interior of the container. This skin portion covering the underside of the flat lid part and the periphery of the lid, protects this lid underside against corrosion. In this case, the lid can be made of a material such as tin plate, which is less resistant to corrosion than the preferred aluminium.

It is one advantage of the valve-and-lid assembly of the invention that a riser tube use of which is preferred in certain types of aerosol spray cans, can be mounted directly on the lid rather than on the valve housing conventionally used in such cases.

BRIEF DESCRIPTION OF THE DRAWING

Further details of the invention will become apparent from the following description thereof in connection with the accompanying drawing in which.

DETAILED DESCRIPTION OF THE EMBODIMENTS SHOWN IN THE DRAWING

Figure 1:
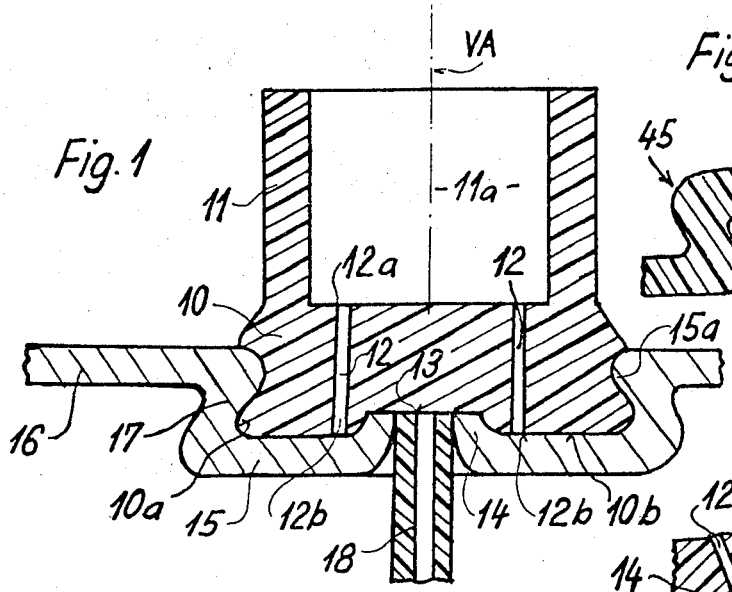
FIG. 1 is an axial sectional view of a first embodiment of the valve-and-lid assembly according to the invention, with the valve parts in closed position.
Figure 2:
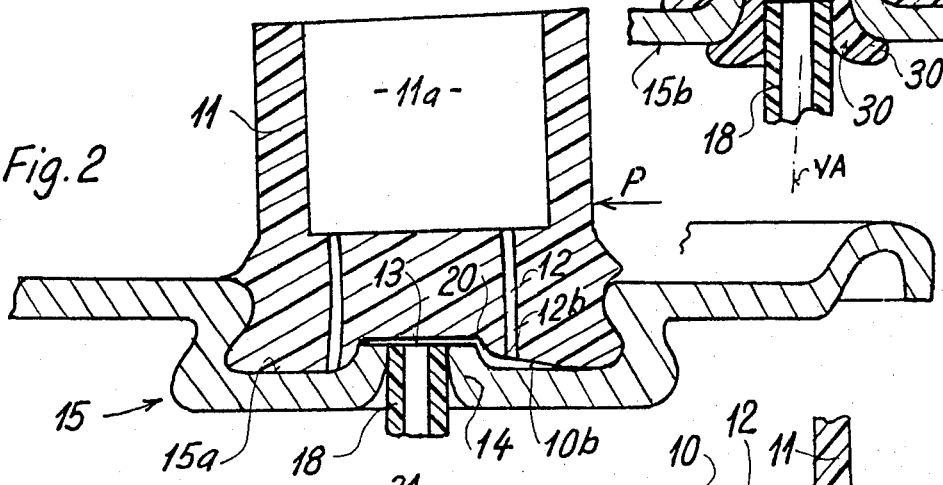
FIG. 2 shows a similar view of the same embodiment with the parts in open position.

The embodiment of a valve-and-lid assembly according to the invention illustrated in FIGS. 1 and 2 comprises a valve disc 10 of elastically resilient material, preferably a polyester elastomer of the Hytrel type sold by E. I. DuPont de Nemours, Wilmington, Del., which disc bears on its outwardly directed upper side a socket or sleeve 11 being integral with valve disc 10. Ducts 12 for the passage of product to be dispensed extend through the valve disc 10 from its underside 10*b* and end in exit openings 12*a* inside the hollow interior 11*a* of socket 11. The valve disc 10 is lodged in a cup-shaped dome part 15 which is vaulted inwardly from the plane of a container lid 16, i.e., toward the interior of a container (not shown) which the lid is destined to close. The sidewall 17 of the dome part 15 is crimped so as to hold the peripheral portion 10*a* of the valve disc 10 firmly in place at all times. The dome part 15, which cooperates with the valve disc 10 as one of the elements of a valve, has in its flat top wall 15*a* a central opening 13 which is surrounded by a collar portion 14. The latter protrudes upwardly from the dome top wall 15*a* toward the interior of dome part 15. A riser tube 18 is firmly inserted in the collar portion 14.

In the closed condition of this embodiment shown in FIG. 1, the opening 13 is hermetically sealed by the underside 10*b* of valve disc 10 and there is thus no free communication with the entry orifices 12*b* of ducts 12. These entry orifices 12*b* are obturated by the flat dome top wall 15*a*.

As can be seen from FIG. 2 illustrating the "open" condition of the valve, a tilting of socket 11 by a finger force exerted on one of its sides, as indicated by the arrow P, causes a deformation of the central part of the valve disc 10 containing the ducts 12 while the peripheral portion of disc 10 is held firmly in place by crimped dome part side wall 17. This deformation affects mainly the underside 10*b* of valve disc 10 lifting the same off the flat top wall 15*a*. Through the resulting gap 20, free communication is established between the upper open end of riser tube 18 in central opening 13 and the entry orifice 12*b* of at least one of the ducts 12. Product thus passing through duct 12 emerges into the interior 11*a* of socket 11 and from there into an atomizer head (not shown) equipped with a spray nozzle or similar discharge means.

Figure 3:
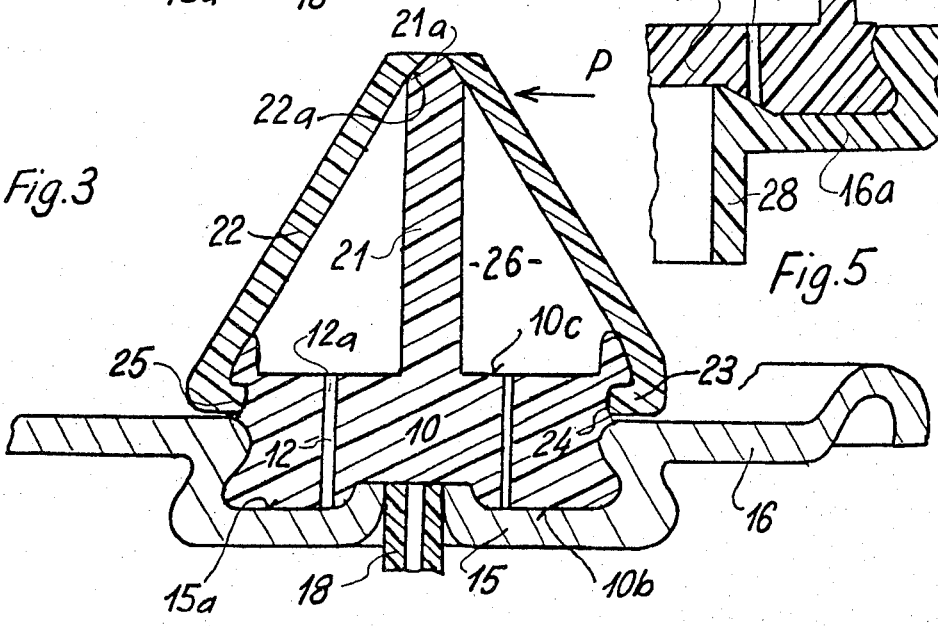
FIG. 3 shows in axial section another embodiment with the parts in closed position.
Figure 6:
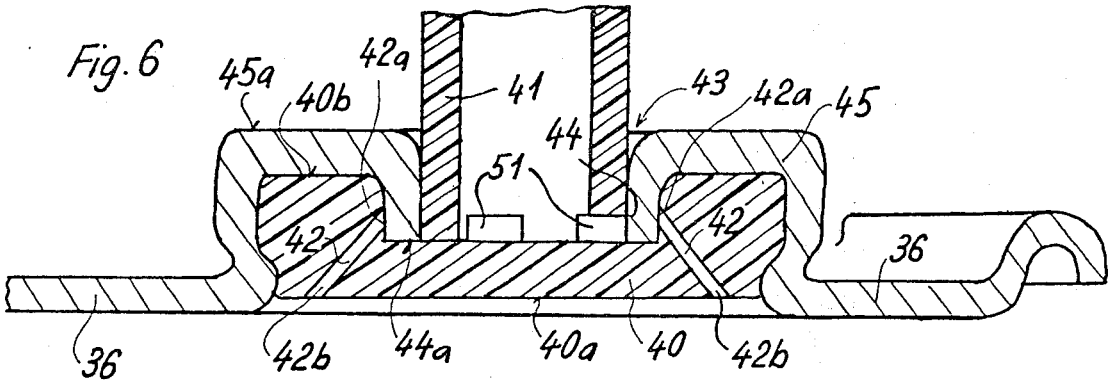
FIG. 6 is an axial sectional view of a further embodiment with the parts in closed position.

In the embodiment shown in FIG. 3, the socket 11 is replaced as actuating means by a rod or mandrel 21 which protrudes from the top face 10*c* of valve disc 10 and is integral with the latter. Rod 21 is surrounded by a conical enveloping mantle 22 which is mounted with its foot end 23 having a rim bead 24 firmly in a corresponding peripheral groove 25 in the sidewall of valve disc 10. At its top end 21*a* the rod 21 is conically bevelled and a correspondingly tapered inside face 22*a* about the upper open end of mantle 22 sealingly engages this conical top end 21*a* when the valve is in closed position. The exit orifices 12*a* of ducts 12 open into the conical interior space 26 inside mantle 22.

Lateral pressure in the direction of arrow P causes the conical faces 21*a* and 22*a* to be displaced by the tilting of the top ends of rod 21 and mantle 22 in such a manner that a gap is opened between them and product can emerge therefrom as soon as tilting is continued to lift the underside 10*b* of valve disc 10 off the flat top wall 15*a* of dome part 15 in the same manner as described at the hand of FIG. 2, supra.

Figure 4:
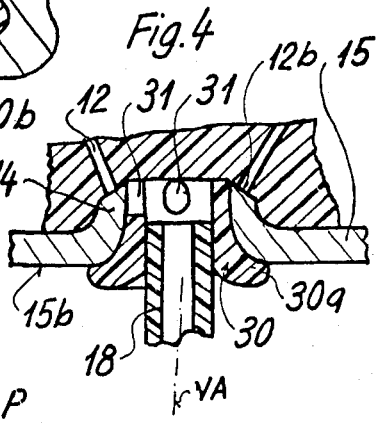
FIG. 4 is an axial sectional view of a detail of varied holding means for the valve disc.

Instead of fastening the valve disc 10 by means of the crimped connection shown in FIGS. 1 and 2 in the dome part 15, the peripheral sidewall of valve disc 10 can also be cylindrical; fastening is then effected by means of flexible and readily stretchable fingers of a collar 30 projecting downward from the underside 10*b* of, and being integral with the valve disc 10. Collar 30 projects downwardly into opening 13 and reaches with its radially extending outer annular flange 30a somewhat underneath the collar portion 14 of dome part 15 and the inner face 16a of top wall 15a of dome part 15, which inner face is turned toward the interior of a container which is closed by lid 16. At its junction with valve disc 10, collar 30 is provided with at least one window 31 through which product passes from the open top end of riser tube 18, which top end is spaced from the underside 10b of valve disc 10 while being held inside collar 30, into the gap opening above the collar portion at tilting of actuating members 21 and 22, and into entry orifice 12b of at least one of ducts 12. (FIG. 4)

Figure 5:
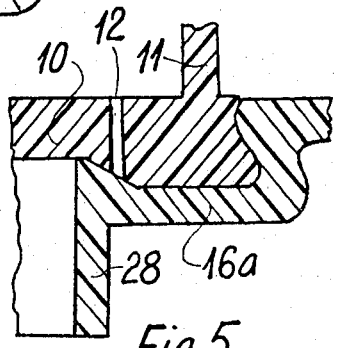
FIG. 5 is an axial sectional view of yet another embodiment of the valve-and-lid assembly in which the lid and riser tube are integral with each other, the parts being shown in closed position.

In the embodiment shown in FIG. 5, the riser tube 28 is integral with the top wall 15a of dome part 15.

In the embodiments illustrated in FIGS. 6 to 9, the cup-shaped domed part 45 of lid 36 is not vaulted inwardly toward a container interior, but outwardly away from that interior. These embodiments are particularly suitable in those cases in which the container does not require a riser tube.

Similar to the previously described embodiments, dome part 45 has a central opening 43 in a flat top wall 45a thereof which opening is surrounded by a collar portion 44 which, in these embodiments, depends downwardly, i.e. toward the container interior, from the flat top wall 45a.

An actuating member in the form of a tubulure 41 which can be the tubular shaft of a conventional atomizer head (not shown) is set in the opening 43 and is held slidingly in collar portion 44 and is provided at its lower end with a lateral port or window 51. A valve disc 40 is held firmly in the interior of dome part 45. Ducts 42 extend from entry orifices 42b in the underside 40a of valve disc 40 through the latter to exit orifices 42a on the upper face 40b thereof. While the entry orifices 42b of ducts 42 are in free communication with the container interior at all times, the exit orifices 42a are obturated by the underside surface 45b of dome part 45 in the region of the collar portion 44, while the valve is in closed position. When pressure on tubulure 41 in the direction of arrow P (FIG. 8) deforms the central portion of valve disc 40, the upper side 40b is moved out of contact with the lower rim 44a of collar portion 44 and free communication is established between the exit orifice 42a of at least one duct 42 and the hollow interior of tubulure 41 via window 51 in the latter.

Figure 6A:
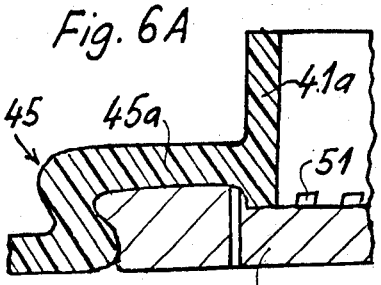
FIG. 6A shows a detail of the same embodiment, but with an actuating sleeve being integral with the lid.
Figure 7:
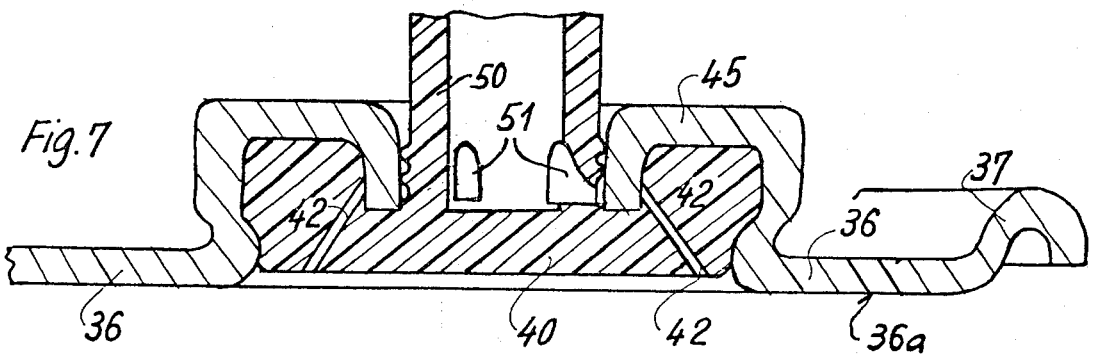
FIG. 7 is an axial sectional view of a similar embodiment as that shown in FIG. 6.

In the embodiment of FIG. 6A, the tubulure 41a is made integral with the flat top wall 45a of upwardly vaulted dome part 45, while in the embodiment of FIG. 7 the tubulure 50 is made integral with the valve disc 40.

Figure 8:
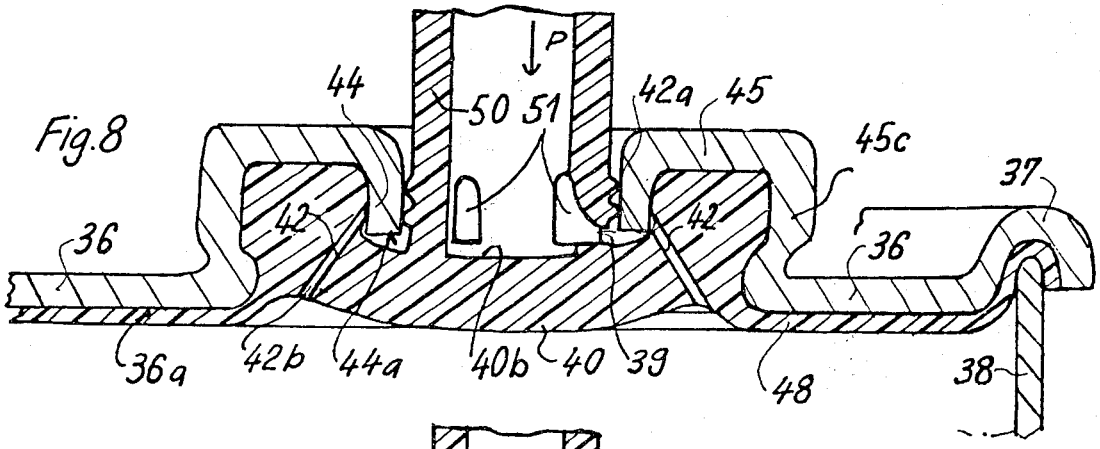
FIG. 8 is yet another embodiment having a protective flange about the valve disc.

FIG. 8 illustrates a further embodiment of the valve-and-lid assembly according to the invention, which is similar to that shown in FIG. 7. However, in this case the valve disc 40 has about its periphery a thin wide annular flange 48 extending radially relative to assembly axis VA and covering the entire underside face 36a of lid 36 and being crimped at its periphery together with the peripheral portion 37 of lid 36 about the top margin of the top rim of a container sidewall 38. The crimped periphery of flange 48 serves simultaneously as a sealing for the crimped lid and container top periphery.

FIG. 8 further shows the deformed central portion of valve disc 40, being in its "open" position due to pressure exerted in the direction of arrow P on tubulure 50 or a spray head (not shown) borne by the latter. Due to this deformation, a gap is formed between the rim 44a of collar portion 44 and the upper side 40b of valve disc 40 through which gap free communication is established between the exit orifices 42a of ducts 42 and, via windows 51, the interior of tubulure 50.

Figure 9:
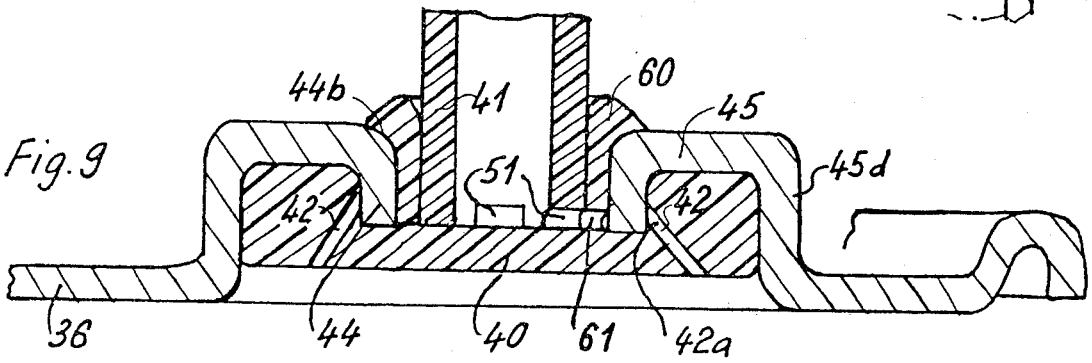
FIG. 9 is an axial sectional view of an embodiment similar to that of FIG. 6, but with special holding means for the actuating sleeve.

In the embodiment shown in FIG. 9, the lateral fastening of the valve disc 40 by means of crimping the sidewall 45c of dome part 45, is replaced, similar to the case of FIG. 4, by fastening collar 60 which protrudes upwardly from the upper side of valve disc 40 and is integral with the latter. The collar 60 is easily stretchable so as to permit downward movement of valve disc 60 within the guiding annular sidewall 45d of dome part 45, and reaches a short distance above the upper side of flat top wall 45a of dome part 45. At its foot end, collar 60 is provided with transverse ducts or windows 61, by way of which product from exit orifices 42a can pass to windows 51 at the lower end of tubulure 41 when the latter is depressed in order to open the valve.

Instead of an atomizer head, the tubulure can also carry a filling head in order to fill a suitable product and/or propellant into the container.

The terms "upward", "downward", "upper side" and "lower side" or "underside" refer to positions of the respective parts as shown in the accompanying drawings, while "inner" and "outer" refer to the container which can be closed by the valve-and-lid assembly according to the invention.

We claim:

1. A self-closing valve-and-lid assembly adapted for closing the open top end of a container fillable with pressurized product comprising:

a lid and rigid collar means protruding centrally on one face of said lid, and bearing an annular contact face, said valve disc being elastically resilient under conditions of filling product into, and discharging product from said container, and having a flat central zone and a peripheral zone about said central zone and being adapted to be firmly clamped-in in said assembly, said peripheral zone being of greater thickness than said central zone when said valve disc is mounted in said assembly, said valve disc having an inner disc face thereof adapted to be turned toward said lid and collar means and being adapted for uninterrupted contact with the entire portion of said lid face facing said valve disc and surrounding said contact face of said collar means, while said assembly is in closed condition, said inner disc face having, in said central zone of said valve disc, an annular contact zone adapted for sealingly contacting said contact face of said collar means, when said assembly is in a closed state, the portion of said valve disc inside said annular contact zone being unperforated, said valve disc having an outer disc face on the side thereof opposite said inner disc face;

and at least one duct extending through said disc from a region of said outer disc face spaced away from said unperforated central disc portion, to said inner disc face and opening out of said inner disc face in a region thereof outside said annular contact zone and adapted for being in contact with said collar means outside said contact zone thereof and the adjacent lid face portion.

2. A container lid being usable in a self-closing valve-and-lid assembly adapted for closing the open top end of a container fillable with pressurized product, which lid has a central axis, the periphery of said lid being adapted for sealing connection with a top rim of a container sidewall surrounding the said container top opening and extending in a plane generally transverse to said lid axis, said lid having a central dome part and a central opening in the middle of said dome part, and being rigid under conditions of filling product into, and discharging product from said container, said lid having a flat lid part about said dome part and extending generally in a main lid plane transverse to said central assembly axis, said dome part having a top wall and a circumferential sidewall which latter extends generally out of said main lid plane, said dome part having a hollow interior delimited by said circumferential sidewall and said top wall and open in said main lid plane, a collar portion of said dome part extending axially relative to said central lid axis from said dome part top wall into said hollow dome part toward said main lid plane, and ending at near the said plane in an annular rim about said central dome part opening, said dome part protruding from said flat lid part on the side thereof adapted to be turned toward the interior of a container.

3. The valve-and-lid assembly of claim 2, wherein said tubular collar part has at least one window registering with a port at the lower end of said actuating means, through which window free communication can be established between at least one duct of said duct means and the interior of said tubular actuating means.

4. Self-closing valve-and-lid assembly adapted for closing the open top end of a container fillable with pressurized product, and having a central assembly axis, comprising, as a first member of said assembly, (I) a lid the periphery of which is adapted for being sealingly connected with a top rim of a container sidewall surrounding the said container top opening, and extending generally transverse to said central assembly axis, (a) said lid having a central dome part and a central opening in the middle of said dome part, and being rigid under conditions of filling product into, and discharging product from said container, (b) said lid having a lid foot part about said dome part and extending generally in a main lid plane transverse to said central assembly axis, (c) said dome part protruding from said lid foot part on one side thereof, adapted to be turned away from or toward the interior of a container, and having a flat dome top wall, extending in a plane substantially parallel to said main lid plane, and a circumferential sidewall, (d) a collar portion of said dome part, extending axially from said flat dome top wall, in opposite direction to that in which said dome part protrudes from said lid foot part, and ending in an annular rim about said central dome part opening; and, as a second member of said assembly, (II) a valve disc being elastically resilient under the above-defined conditions and having an outer disc face turned away from the interior of said flat dome top wall, a peripheral disc zone, and an inner disc face, resting upon an inner face of said flat dome top wall turned toward the interior of said dome part, said disc inner face bearing a central contact zone thereof being, in closed state, in sealing contact within a region comprising said collar portion of said dome part and the region of said top wall vicinal to said collar portion, said valve disc further having duct means comprising at least one duct extending through said disc from said outer disc face thereof to said inner disc face and opening out of the latter face in said contact zone, and (III) finger-engageable actuating means connected with said valve disc on the upper disc face thereof and adapted for so deforming said valve disc in the range of said central contact zone, when applying tilting pressure transverse to said central assembly axis to one side of said actuating means, that at least part of said contact zone is moved out of engagement with said collar portion, opening a free passage through at least one duct of said duct means;

(IV) one of said two members, consisting of said elastically resilient valve disc and said rigid lid, having a crimped portion gripping from above and from below a clamped-in portion of the other member which portion extends substantially in axial direction spaced from said central assembly axis.

5. The valve-and-lid assembly of claim 4, wherein said crimped portion is the circumferential sidewall of said dome part and the clamped-in portion is the peripheral disc zone of said valve disc.

6. The valve-and-lid assembly of claim 4, wherein said dome part protrudes from said flat lid part on the underside thereof adapted to be turned toward the interior of a container.

7. The valve-and-lid assembly of claim 6, further comprising a riser tube inserted in said collar portion and adapted to extend into said container interior and opening in a bottom zone of said container.

8. The valve-and-lid assembly of claim 4, wherein said dome part protrudes from said fast lid part on the side of the latter adapted for facing away from the interior of a container.

9. The valve-and-lid assembly of claim 8, wherein said actuating means are connected with the said inner disc face inside said central opening of said dome part and protrude upwardly out of said opening.

10. The valve-and-lid assembly of claim 9, wherein said actuating means is of tubular shape and has an axial passage which registers with said central opening of said dome part and an inner end wall resting in positive contact with said contact zone of said disc inside said central dome part opening, said end wall of said actuating means having at least one port therein, adapted for registering with a gap formed between said annular rim of said collar portion and said contact zone of said disc, when finger pressure is exerted on said actuating means.

11. The valve-and-lid assembly of claim 10, wherein said tubular actuating means are integral with said disc.

12. The valve-and-lid assembly of claim 8, wherein said disc has an underside face opposite said inner disc face and adapted to be turned toward the interior of a container and comprises a peripheral skin portion covering the underside of said lid including the underside of said foot lid part and the periphery of said lid, whereby said underside of said lid is protected against corrosion.

13. The valve-and-lid assembly of claim 6, wherein said valve disc bears on its inner, lower face, as said crimped portion, a tubular collar part extending from said inner, lower disc face downwardly into said collar portion of said lid and protruding downwardly out of said central dome opening, said tubular collar part having at its lower end a radially outwardly extending flange adapted for clampingly engaging the underside of said flat dome top wall in the vicinity of said central opening, thereby clamping in said collar portion, said tubular collar part having at least one cut-out in its wall at its upper end, through which cut-out free communication can be established from the interior of a container to at least one duct of said duct means, when said actuating means are tilted to open a gap, in the region about said rim of said collar part, between said valve disc underside and the upper face of said flat dome top wall.

14. The valve-and-lid assembly of claim 7, wherein said valve disc comprises a sleeve part depending from said contact zone and extending downward into the interior of said collar portion between an inner wall of the latter and said riser tube, and said riser tube having an open top end inserted in said sleeve part and ending at a level in said collar portion spaced from the underside of said valve disc above said collar portion, said sleeve part having at least one window therein opening into the space between the open top end of said riser tube and the contact zone on the underside of said valve disc thereabove.

15. The valve-and-lid assembly of one of claims 8 to 12, wherein said valve disc bears on its upper, inner face, as said crimped portion, a tubular collar part protruding upwardly into said collar portion of said lid, which tubular part has at its upper end a radially outwardly extending flange adapted for clampingly engaging the upper face of said dome part top wall thereby clamping in said collar portion, said tubular actuating means being inserted in said tubular valve disc collar part.

16. The valve-and-lid assembly of claim 4, wherein said dome part protrudes from said flat lid part on the side of the latter adapted for facing away from the interior of a container, said collar portion has an outer wall surface surrounding said central opening and an inner wall surface facing toward said circumferential dome part sidewall, said inner disc face being in sealing contact with said outer wall surface of said collar portion and with said flat dome top wall while said assembly is in closed condition, at least one duct opening out of said inner disc face in the part of said contact zone being in contact with said outer wall surface of said collar portion.

* * * * *

UNITED STATES PATENT AND TRADEMARK OFFICE

CERTIFICATE OF CORRECTION

PATENT NO. : 4,410,110

DATED : October 18, 1983

INVENTOR(S) : Luigi Del Bon, et al

It is certified that error appears in the above-identified patent and that said Letters Patent is hereby corrected as shown below:

Column 7, line 24, "3." should read --15--, and "claim 2" should read --claim 14--.

line 30, "4." should read --3.--.

Column 8, line 20, "5." should read --4.--, and "claim 4" should read --claim 3--.

line 24, "6." should read --5.--, and "claim 4" should read --claim 3--.

line 28, "7." should read --6.--, and "claim 6" should read --claim 5--.

line 32, "8." should read --7.--, and "claim 4" should read --claim 3--.

line 36, "9." should read --8.--, and "claim 8" should read --claim 7--.

line 40, "10." should read --9.--, and "claim 9" should read --claim 8--.

line 50, "11." should read --10.--, and "claim 10" should read --claim 9--.

line 52, "12." should read --11.--, and "claim 8" should read --claim 7--.

line 59, "13." should read --12.--, and "claim 6" should read --claim 5--.

UNITED STATES PATENT AND TRADEMARK OFFICE

CERTIFICATE OF CORRECTION

PATENT NO. : 4,410,110

DATED : October 18, 1983

INVENTOR(S) : Luigi Del Bon, et al

It is certified that error appears in the above-identified patent and that said Letters Patent is hereby corrected as shown below:

Column 9, line 8, "14." should read --13.--, and "claim 7" should read --claim 6--.

line 20, "15." should read --14.--. and "claims 8 to 12" should read --claims 7 to 11--.

Column 10, line 8, "claim 4" should read --claim 3--.

Signed and Sealed this

Second Day of October 1984

[SEAL]

*Attest:*

GERALD J. MOSSINGHOFF

*Attesting Officer*

*Commissioner of Patents and Trademarks*